United States Patent [19]

Samario

[11] Patent Number: 4,662,581

[45] Date of Patent: May 5, 1987

[54] MODIFIED NULL FLOW MODULATOR

[75] Inventor: Edward J. Samario, Los Gatos, Calif.

[73] Assignee: The United States of America as represented by the Secretary of the Navy, Washington, D.C.

[21] Appl. No.: 754,556

[22] Filed: Jul. 15, 1985

[51] Int. Cl.[4] ..... F42B 15/033

[52] U.S. Cl. ..... 244/3.22

[58] Field of Search ..... 244/3.22, 169

[56] References Cited

U.S. PATENT DOCUMENTS 3,612,442 10/1971 Chisel ..... 244/3.22

4,550,888 11/1985 Douglass et al. ..... 244/3.22

*Primary Examiner*—Charles T. Jordan

*Attorney, Agent, or Firm*—R. F. Beers; C. D. B. Curry; W. C. Daubenspeck

[57] ABSTRACT

A method of pulse-width modulation for operating oppositely aligned thruster valves of an integrated valve assembly in an aerospace post-boost control system in which zero average thrust during a modulation period is provided by commanding the thruster valves to be simultaneously on for a selected portion of the modulation period and simultaneously off for the rest of the modulation period. Non-zero average thrust is provided by varying the simultaneous operation of the thruster valves established for zero average thrust by commanding an increased on-time for one thruster valve while commanding a correspondingly decreased on-time for the other thruster valve, the excursions in on-time and in off-time occurring around the zero-thrust turn-on time or the zero-thrust turn-off time.

9 Claims, 9 Drawing Figures

MODIFIED NULL FLOW MODULATOR

BACKGROUND OF THE INVENTION

This invention relates in general to flight control in aerospace platforms during the post-boost phase of operation and, in particular, to a modulation technique for providing pulse-width modulation for operating the thruster valves used to provide attitude and velocity control of the aerospace platforms.

For the deployment of packages from an aerospace platform during the post-boost phase of a mission profile, it is necessary to provide attitude and velocity control of the platform in response to flight control commands. This attitude and velocity control is provided by a plurality of integrated valve assemblies connected to a solid propellant gas generator. Each integrated valve assembly (IVA) has a pair of oppositely aligned high thrust nozzles which are oriented parallel to the missile longitudinal axis and a pair of oppositely aligned low thrust nozzles which are oriented perpendicular to the missile longitudinal axis. Each nozzle can be independently opened or closed by a command signal from a flight control package. The opposing valve pairs are operated in a pulse-width-modulation mode in order to present a nearly constant expulsion area to the gas generator.

One method of pulse-width modulation, known as constant flow modulation, is illustrated in FIG. 1*a* which show the thrust command time history of a valve pair during one modulation period T. Level +1 indicates that one of the two valves is commanded "on", level −1.0 indicated that the second valve is commanded "on", and level 0 indicates a valve "off" command. With a zero average thrust command (0 percent modulation), the valve commands appear as the solid curve 10. Modulating the command to provide non-zero thrust is achieved by varying the transition point where one valve is switched off and the other valve is switched on as indicated by dashed lines 12 representing 25 percent modulation. Constant flow modulation has the advantage of having a linear average-thrust versus command characteristic near zero thrust command. However, it has the disadvantage that near zero thrust command it causes a large exitation of the bending modes.

A second modulation method, known as null flow modulation, does not appreciably excite bending modes. However, near zero thrust command, null flow modulation has a non-linear transfer characteristic which increases the difficulty of deployment with accuracy. As represented by the solid lines 14 and 16 in FIG. 1*b*, in null flow modulation, zero average thrust (0 percent modulation) is achieved with both valves continuously "on". When a small average thrust is desired, one of the valves must be turned "off" and "on" over very short period as indicated by dashed lines 18 and 20, respectively. The inability of real valves to achieve this cycling for periods less than approximately 30 milliseconds causes the non-linear characteristic near zero thrust command.

SUMMARY OF THE INVENTION

It is therefore an object of the present invention to provide a method of pulse-width modulation which combines the advantages of constant flow modulation and null flow modulation.

Another object is to provide a method of pulse-width modulation which is linear near zero thrust command.

Another object is to provide a method of pulse-width modulation which does not excite bending modes with zero average thrust command.

Another object is to provide a method of pulse-width modulation which is compatible with providing uniform loading of the gas generator in a post-boost control system.

These and other objectives are provided by a pulse-width modulation method referred to herein after as modified null flow modulation. In modified null flow modulation according to the present invention, zero average thrust (0 percent modulation) is provided by commanding opposing nozzles of an integrated valve assembly to be simultaneously on for a specified portion of the modulation period and simultaneously off for the rest of the modulation period. Non-zero thrust is provided by varying the simultaneous operation of the thruster valves established for zero average thrust by increasing the on time for one thruster valve and decreasing the on time for the other thruster valve by the same amount.

The advantages and features of the present invention will be better understood from the following detailed description of the preferred embodiment when considered in conjunction with the accompanying drawings wherein:

BRIEF DESCRIPTION OF THE DRAWINGS

FIG. 5 represents a pair of oppositely aligned nozzles of an integrated valve assembly;

DESCRIPTION OF THE PREFERRED EMBODIMENT

Figure 2:
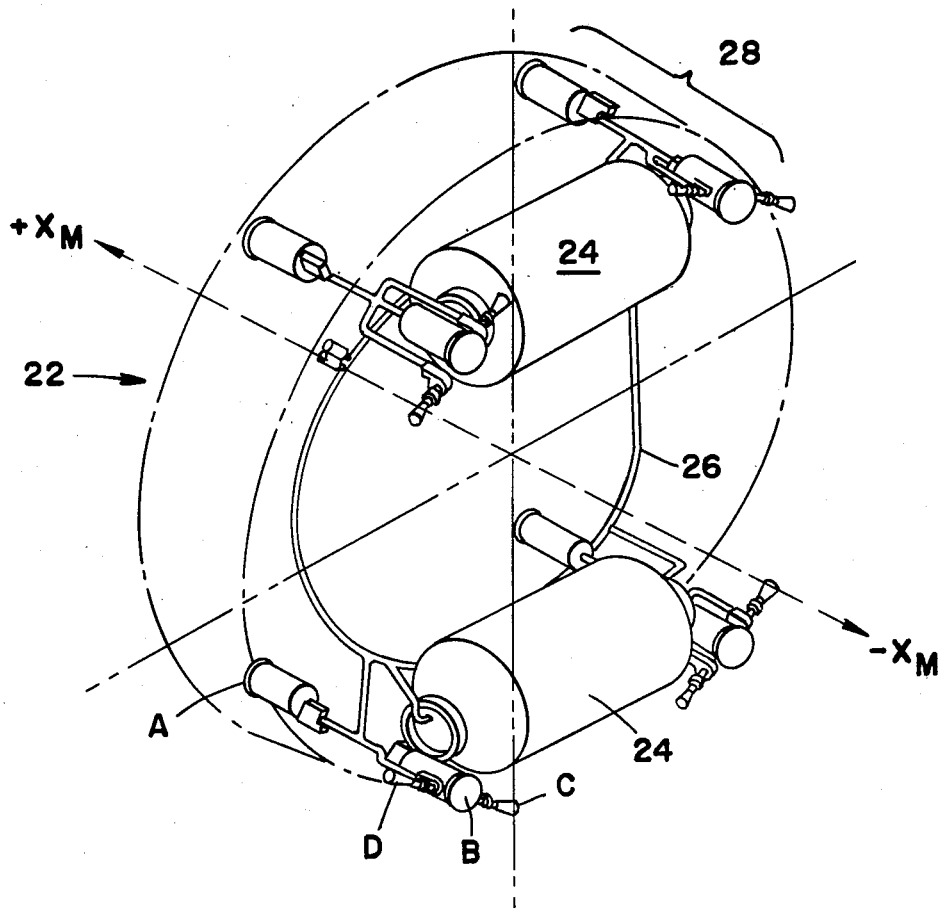
FIG. 2 is a simplified schematic view of an aerospace platform illustrating integrated valve assemblies.

Referring now to the drawings, FIG. 2 illustrates an aerospace platform 22 and post-boost control system of the type with which the method of the present invention may be employed. The post-boost control system which provides attitude and velocity control for the platform 22 includes two solid propellant gas generators 24 (operated sequentially) which are coupled in parallel by a manifold 26 to four integrated valve assemblies 28. Each integrated valve assembly 28 includes two opposing high thrust nozzles A and B oriented to provide thrust parallel to the missile longitudinal axis $X_m$ in the $+X_m$ direction and the $-X_m$ direction, respectively. Each integrated valve assembly 28 also includes two opposing low thrust nozzles C and D (roll valves oriented to provide thrust in the plane normal to the missile longitudinal axis $X_m$. Each nozzle can be independently opened and closed by a command signal from the autopolit of the control system. The valves are operated in the pulse-width modulation mode; that is, the valves are commanded on and off to provide an average effective throat area over the on/off cycle.

There are in general two operating modes: (1) coarse mode for providing velocity increments for deployment spacing between a plurality of payload packages, and (2) vernier mode for precise attitude and deployment control. During the coarse mode a higher pressure is maintained at the gas generator 24 which provides a higher propellant burn-rate and thus a higher thrust through the valves. During the vernier mode, a lower pressure is maintained at the gas generator 24 to provide a lower burn rate and thus a lower thrust through the valves. In order to maintain the required pressure at the gas generator 24, the combined nozzle throat area presented by all the valves is maintained essentially constant.

Figure 1A:
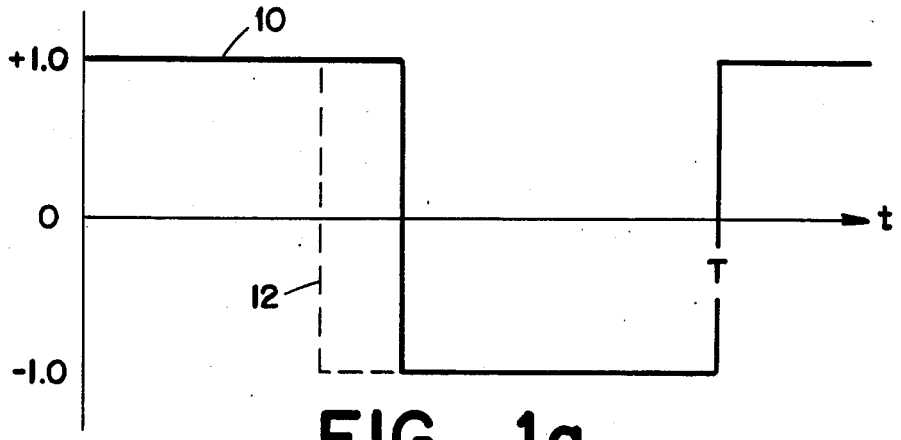
FIG 1a (PRIOR ART)
FIG. 1*a* is a thrust-command time history of a valve pair illustrating constant flow pulse-width modulation.
Figure 1B:
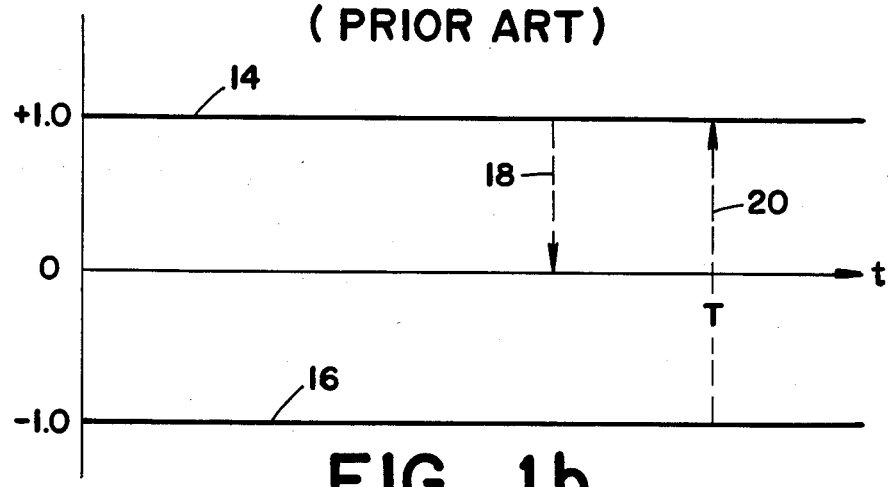
FIG 1b (PRIOR ART)
FIG. 1*b* is a thrust-command time history of a valve pair illustrating null flow pulse-width modulation.
Figure 3:
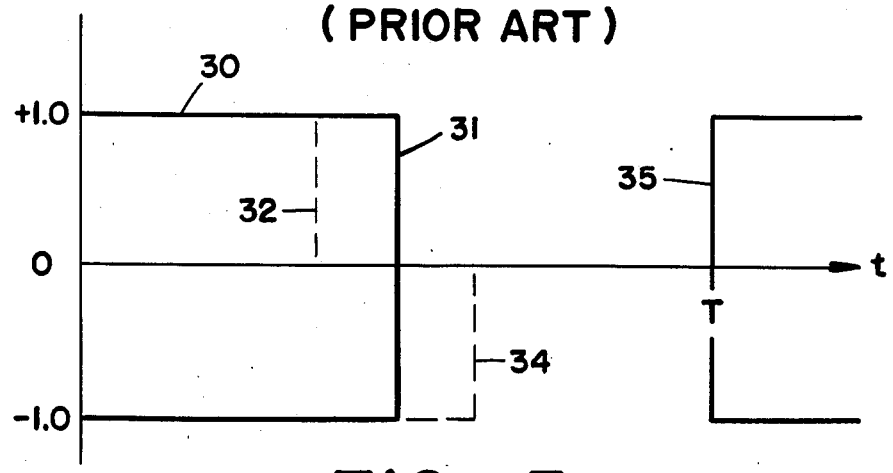

The modified null flow pulse-width modulation technique of the present invention is illustrated in FIG. 3. In the modified null flow technique, zero average thrust (0 percent modulation) is provided by commanding opposing nozzles of the integrated valve assembly, such as nozzle A and nozzle B, simultaneously on for one-half of the modulation period and simultaneously off for one-half the modulation period as represented by solid line 30. Non-zero thrust is achieved by turning one valve off before the zero-thrust turnoff 31 as indicated by dashed line 32 and extending the on time for the other valve for an equal time beyond the zero-thrust turnoff as indicated by dashed line 34 (approximately 25 percent modulation is illustrated by dashed lines 32 and 34). In practice, non-zero thrust is normally achieved by modulating both the valve turn-off times and the valve turn-on times from the zero thrust times. Since the valves are turned on and off over a period comparable to hold the modulation period, the transfer characteristic is linear. The effective average throat area presented by both the valves remains the same as presented in the zero-thrust condition. In addition, with no average thrust command, the force out of the valve pair is (ideally) continuously zero so that the bending modes are not excited.

Figure 4:
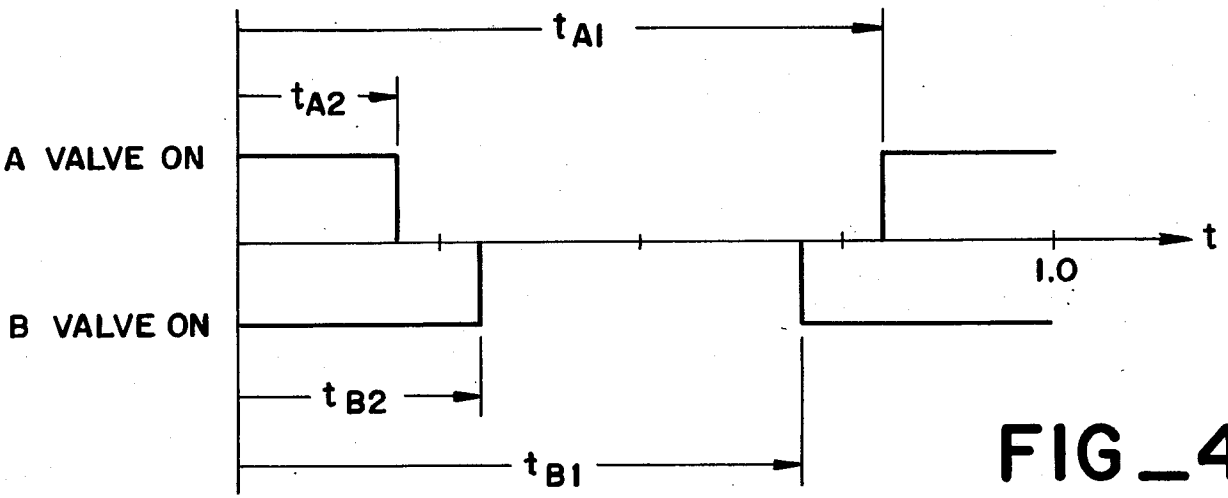
FIG. 4 illustrates the idealized desired thrust from a pair of oppositely aligned nozzles that form an integrated valve assembly.
Figure 5:
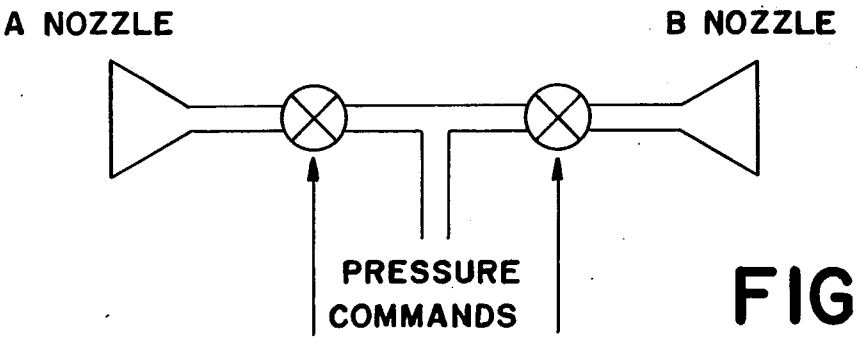
FIG. 5 is a thrust-command time history of a valve pair illustrating modified null flow pulse-width modulation as contemplated by the present invention.

Referring to FIGS. 4–7, the implementation of the modified null flow modulator will now be described. FIG. 4 represents the idealized desired thrust or time-force history desired from a pair of oppositely aligned nozzles that form an integrated valve assembly. The unit of time is the repetition period of the pulse-width-modulation (PWM) period. Subscripts A and B refer to the A and B valves in the integrated valve assembly as illustrated in FIG. 5. Subscript 1 refers to valve turn-on switching time, and subscript 2 denotes valve turn-off switching time.

The switching times of the modified null flow modulator are selected to satisfy the following criteria:

$$t_{A1}+t_{A2}=1.0$$

$$t_{B1}+t_{B2}=1.0 \qquad (1)$$

These criteria provide "on" symmetry about the origin and "off" symmetry about the $t=0.5$ period for each valve. The selection of these criteria is arbitrary, as is the decision to identify the waveform in FIG. 5 as having zero phase. If the waveform in FIG. 4 were to exist, the average (over the period) net force would be:

$$C1 = t_{A2} - t_{B2} + t_{B1} - t_{A1} \qquad (2)$$

$$= 2(t_{B1} - t_{A1})$$

The average throat area (normalized to two nozzle throat areas) observed by the gas generator is:

$$C2 = (t_{A2} + (1 - t_{A1}) = t_{B2} + (1 - t_{B1}))/2 = 2 - t_{A1} - t_{B1} \qquad (3)$$

In other words, when the total throat area, as seen by the gas generator, is equal to two nozzle throat areas, the quantity C2 equals 1.0.

Solving equations 1, 2 and 3 for the switching times provides:

$$t_{A1}=1-C2/2-C1/4$$

$$t_{B1}=1-C2/2-C1/4 \qquad (4)$$

The C1 and C2 switching times can now be defined as follows:

$$C1 = \text{desired average net force, and } -1.0 \leqq C1 \leqq 1.0 \qquad (5)$$

$$C2 = \text{desired average throat area (normalized), and } 0 \leqq C2 \leqq 1.0$$

The switching times are now defined by equations 1 and 4, with the following constraints which are necessary to maintain the switching times within their boundaries.

$$0.5 \leqq t_{A1},\ t_{B1} \leqq 1.0 \qquad (6)$$

Accordingly, if the solution to equation 4 yields $$t_{A1} \geqq 1.0 \text{ set } t_{A1}=1.0$$

$$t_{B1} \geqq 1.0 \text{ set } t_{B1}=0.0$$

$$t_{A1} \leqq 0.5 \text{ set } t_{A1}=0.5$$

$$t_{B1} \leqq 0.5 \text{ set } t_{B1}=0.5 \qquad (7)$$

The switching times (as obtained from equation 4 may not satisfy the boundary restrictions of equation 7 because commands C1 and C2 may be physically unrealizable. For example, C1 may be commanded to be 1.0 (that is, the A valve is on), whereas the area command is zero, which implies that both A and A valves are off.

Figure 6:
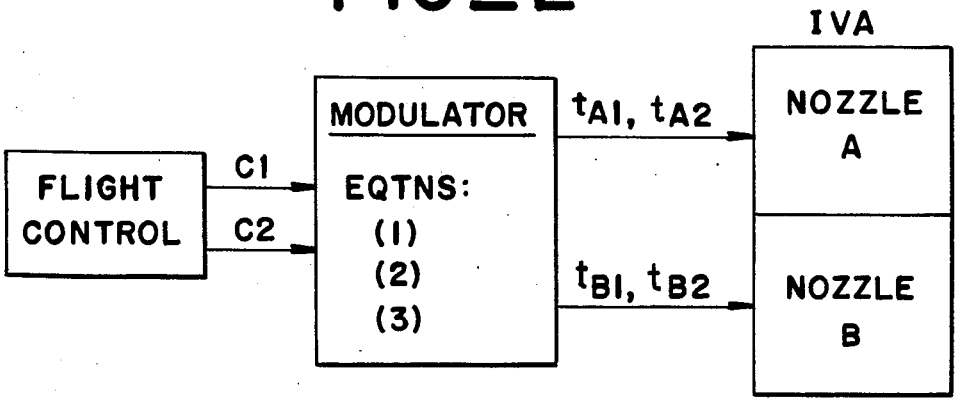
FIG. 6 is a simplified block diagram illustrating the operation of the modified null flow modulator.

Thus as illustrated in FIG. 6, the null flow modulator solves switching times using equations 4 and 6 and the laws of symmetry, as given in equation 1 in response to the commands of equation 5. The preferred implementation is to employ firmware to generate the required valve control signals.

The phase of the waveform has been arbitrarily initiated at the beginning of the period. The waveform that has "on" symmetry about t=0 is designated as zero phase; however, "on" symmetry may be achieved at any time in the period. When a plurality (eight in the system illustrated in FIG. 2) of integrated valve assemblies are being controlled, they need not all have the same phase. There are good reasons for phasing the valve assemblies to satisfy other objectives, such a uniform loading of a gas generator, bending and so forth.

In addition, the phase of each valve assembly need not be equally spaced during the pulse-width-modulation period, nor need the phase be constant; it can be random to provide phase jitter, thereby mitigating bending phenomena, or it can be changed to improve gas generator loading when a nozzle is not used (as in near-nozzle-off operation).

Figure 7A:
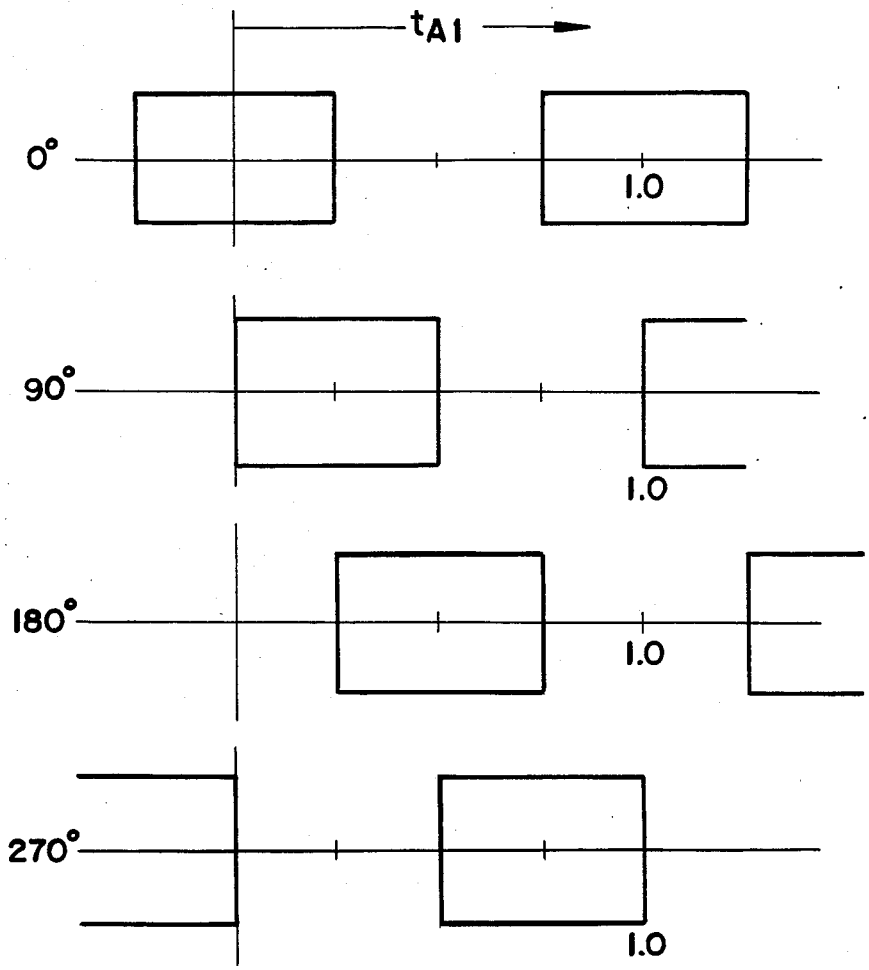
FIGS. 7*a* and 7*b* illustrate orthogonal phasing for four valve pairs for zero percent modulation and twenty percent modulation, respectively.
Figure 7B:
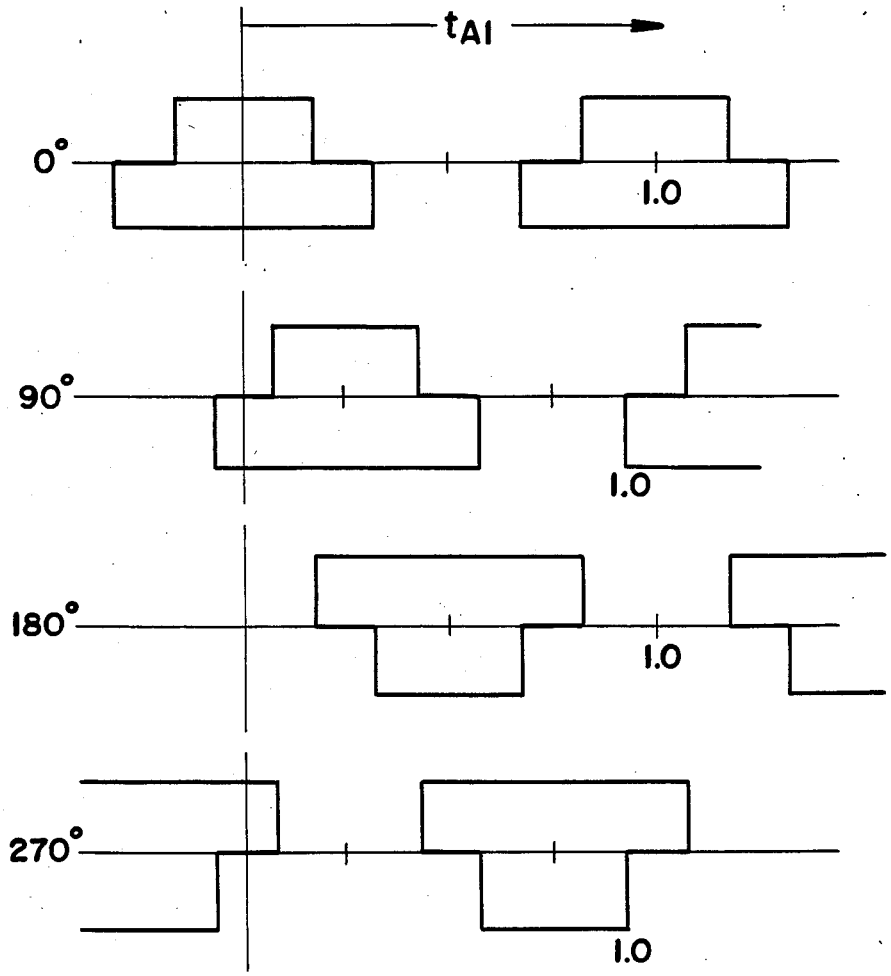

FIG. 7*a* illustrates orthogonal phasing for each of the four main A and B valves for 0 percent modulation. This phasing may be desirable in order to present a more nearly constant loading on the gas generator. FIG. 7*b* illustrates one possible implementation of 20 percent modulation on the basic orthogonal phasing of FIG. 7*a*. It can be stated that "typically" four valves are on at any given time. Instantaneously, it is possible that 2, 4 or 6 valves are on. However, in the modified null flow modulation of the present invention, exactly one valve of each pair is "on" over a modulation period. For the four valve pairs, exactly four valves are continuously "on" over a modulation period. Thus a nearly constant expulsion area is maintained to provide uniform loading of the gas generator.

Obviously many modifications and variations of the present invention are possible in light of the above teachings. It is therefore to be understood that within the scope of the appended claims the invention may be practiced otherwise than as specifically described.

What is claimed is:

1. A method of pulse-width modulation for operating oppositely aligned thruster valves of an integrated valve assembly, said method comprising for zero average thrust during a modulation period:

(a) commanding said oppositely aligned thruster valves to be simultaneously on for a selected portion of the modulation period;

(b) commanding said oppositely aligned thruster valves to be simultaneously off for the rest of the modulation period, a zero average thrust turn-off time and a zero average thrust turn-on time being established thereby; and said method comprising for non-zero average thrust during a modulation period (c) varying the simultaneous operation of the thruster valves established for zero average thrust by commanding an increased on time for one thruster valve and commanding a decreased on time for the other thruster valve.

2. A method as recited in claim 1 wherein said selected portion of the modulation period is equal to one-half of the modulation period.

3. A method as recited in claim 1 wherein the step of varying the simultaneous operation of the thruster valves established for zero average thrust comprises:

(a) commanding one of said oppositely aligned thruster valves off at a selected time before the zero average thrust turn-off time; and (b) commanding the other of said opposite aligned thruster valves to remain on for a time equal to said selected time after said zero thrust turn-off time.

4. A method as recited in claim 1 wherein the step of varying the simultaneous operation of the thruster valves established for zero average thrust comprises:

(a) commanding one of said oppositely aligned thruster valves on at a selected time before the zero average thrust turn-on time; and (b) commanding the other of said opposite aligned thruster valves to remain off for a time equal to said selected time after said zero thrust turn-on time.

5. A method as recited in claim 3 wherein said selected portion of the modulation period is equal to one-half of the modulation period.

6. A method as recited in claim 4 wherein said selected portion of the modulation period is equal to one-half of the modulation.

7. A method of pulse-width modulation for operating oppositely aligned thruster valves of an integrated valve assembly, said method comprising for zero average thrust during a modulation period:

(a) turning each of said oppositely aligned thruster valves on at the beginning of said modulation period, thereby establishing a zero average thrust turn-on time;

(b) turning each of said oppositely aligned thruster valves off at a first selected time of said modulation periodm thereby establishing a zero average turn-off time; and said method comprising for non-zero average thrust during a modulation period;

(c) varying the simultaneous operation of said thruster valves established for zero average thrust by increasing the on time for one of said thruster valves and decreasing the on time for the other of said thruster valves.

8. A method as recited in claim 7 wherein step of varying the simultaneous operation of said thruster valves established for zero average thrust by increasing the on time for one of said thruster valves and decreasing the on time for the other of said thruster valves comprises:

(a) turning one of said oppositely aligned thruster valves on at a selected time before the zero average turn-on time; and (b) turning the other one of said oppositely aligned thruster valves on at a time equal to said selected time after the zero average turn-on time.

9. A method as recited in claim 7 wherein said step of varying the simultaneous operation of said thruster valves established for zero average thrust by increasing the on time for one of said thruster valves and decreasing the on time for the other of said thruster valves comprises:

(a) turning one of said oppositely aligned thruster valves off at a selected time before the zero average turn-off time; and (b) turning the other one of said oppositely aligned thruster valves off at a time equal to said selected time after the zero average turn-off time.

* * * * *